United States Patent [19]

Hecker et al.

[11] Patent Number: 4,459,204

[45] Date of Patent: Jul. 10, 1984

[54] USE OF LOWER ALCOHOLS AS OXYGEN SOURCE IN HYDROCARBON SWEETENING

[75] Inventors: William C. Hecker, Orem, Utah; Richard C. Robinson, San Rafael; Robert L. Jacobson, Vallejo, both of Calif.

[73] Assignee: Chevron Research Company, San Francisco, Calif.

[21] Appl. No.: 535,147

[22] Filed: Sep. 23, 1983

[51] Int. Cl.[3] ..... C10G 27/04

[52] U.S. Cl. ..... 208/191; 208/189

[58] Field of Search ..... 208/191, 205, 189

[56] References Cited

U.S. PATENT DOCUMENTS

| | | | |
|---|---|---|---|
| 2,181,037 | 11/1939 | Wilson | 208/205 |
| 2,556,836 | 6/1951 | Browder et al. | 208/205 |
| 2,593,761 | 4/1952 | Johnstone | 208/189 |
| 2,724,681 | 11/1955 | Millikan | 208/189 |
| 2,744,854 | 5/1956 | Urban | 208/191 |
| 2,792,334 | 5/1957 | Megverian | 208/191 |
| 3,117,077 | 1/1964 | Brooke | 208/191 |
| 3,454,488 | 7/1969 | Lewis et al. | 208/191 |
| 3,809,643 | 5/1974 | Chun et al. | 208/191 |
| 4,163,708 | 8/1979 | Jacobson et al. | 208/246 |
| 4,259,213 | 3/1981 | Bishop | 252/463 |

*Primary Examiner*—Delbert E. Gantz
*Assistant Examiner*—Anthony McFarlane
*Attorney, Agent, or Firm*—Burns, Doane, Swecker & Mathis

[57] ABSTRACT

Small amounts of lower alcohols are admixed with sour hydrocarbons and the mixture is contacted with a copper-containing catalyst at an elevated temperature. The alcohol serves as the oxygen source for the catalytic oxygenative conversion to disulfides of mercaptans souring the hydrocarbon.

14 Claims, No Drawings

USE OF LOWER ALCOHOLS AS OXYGEN SOURCE IN HYDROCARBON SWEETENING

BACKGROUND OF THE INVENTION

Field of the Invention

This invention relates to hydrocarbon refining. More particularly, it concerns a process for catalytically sweetening hydrocarbons.

Description of the Prior Art

Many refinery hydrocarbon streams including feedstocks, fractions and products contain minor amounts of mercaptans (thiols) and hydrogen sulfide ($H_2S$). These sulfur-containing materials impart objectionable odors and corrosiveness to the hydrocarbons. Hydrocarbons containing these materials are referred to as "sour" hydrocarbons and are commonly treated to remove the mercaptans or to convert them to nonodiferous, noncorrosive disulfides, thereby forming a "sweet" hydrocarbon.

The conversion of mercaptans to disulfides has conventionally employed molecular oxygen as a reactant with a sweetening catalyst usually containing copper. The overall chemical reaction involved in the conversion of mercaptans to disulfides is:

$$2RSH+\tfrac{1}{2}O_2 \rightarrow RSSR+H_2O$$

wherein R is a hydrocarbon radical, typically an alkyl.

Two representative patents concerning this process of the art or the catalysts employed in it are U.S. Pat. Nos. 3,809,643 issued May 7, 1974 and its continuation 3,907,666, issued Sept. 23, 1975.

Australian Pat. No. 159430 (Published 24 April 1952) discloses that free oxygen, together with a supported copper salt, can sweeten a hydrocarbon. U.S. Pat. No. 3,454,488 discloses a catalyst for use in a free oxygen-based process as does U.S. patent application Ser. No. 301,532 filed on Sept. 14, 1981. That application is commonly assigned herewith.

These prior processes require elevated pressures to get adequate oxygen into the feedstocks. This calls for compressors and pressure-capable equipment which can be expensive and complicate the refining process. Moreover, the art notes that the amount of $O_2$ added as molecular oxygen must be controlled if undesired oxidation of the feedstock itself and gum formation are to be avoided.

SUMMARY OF THE INVENTION

It has now been found that the covalently bound oxygen in lower alcohols is an excellent source of oxygen for catalytic sweetening of hydrocarbons. Thus, this invention provides a process for sweetening a sour hydrocarbon comprising admixing a small amount of lower alcohol with the hydrocarbon and contacting the mixture in liquid phase under sweetening conditions with a catalyst comprising copper and/or its oxides and/or sulfides whereby the mercaptans and $H_2S$ in the sour hydrocarbon are converted to disulfides and the hydrocarbon is sweetened.

DETAILED DESCRIPTION OF THE INVENTION

Hydrocarbon Feedstock

The sour hydrocarbon materials that may be sweetened using the process of this invention are typically of petroleum, oil shale, coal, or tar sand origin. These materials are typically $C_5$ through about $C_{12}$ hydrocarbon materials and will usually have a boiling range of about 10° C. to about 325° C. at 760 mm Hg, more usually 20° C. to 300° C. at 760 mm Hg. Petroleum fractions falling in this range include gasoline, light and heavy naphthas, kerosene, jet fuel, diesel fuel and light fuel oils. These fractions may be straight-run or cracked. Typical sour feedstocks normally contain between about 10 and 500 wppm and more usually 20 to 300 wppm, mercaptan and/or $H_2S$ sulfur.

Alcohol Addition

Alcohol is added to the hydrocarbon feedstock. Methanol is the most preferred alcohol but other members of the one to three carbon alcohols - i.e. methanol, ethanol, and n- and iso-propanol may be employed, if desired. Mixtures of alcohols may be employed. The amount of alcohol added is a small amount relative to the amount of feedstock, i.e. less than about 1% by volume based on the feedstock. Preferably it is from about 50 to about 1000 ml of alcohol per 42 gallon barrel of feed which, on a ppm by volume basis, is from about 300 to 6000 parts per million by volume. The alcohol is added to the hydrocarbon prior to its contact with the catalyst.

Catalyst

The catalyst employed in this invention is a copper catalyst. The copper component of the catalyst is copper metal, copper oxide, and/or copper sulfide. The copper component should be in a relatively finely divided form and generally is supported by or dispersed on a natural or synthetic refractory oxide of one or more of the Group II, III or IV metals. Examples of these refractory metal oxides include alumina, silica, boria, titania, zirconia, silicaalumina, attapulgite clay, kieselguhr, pumice, and the like. The copper catalyst can contain other materials such as iron, chromium, nickel and the like, if desired. Although the present invention resides in the use of alcohol as oxygen source, and is not limited to any particular copper catalyst, we have had best results employing as catalyst in this conversion process a material that is currently used as a sorbent or scavenger to remove mercaptans and other sulfur-containing compounds from naphtha, petroleum distillates or other hydocarbons. Its use as a sulfur scavenger is taught in U.S. Pat. Nos. 4,163,708 and 4,259,213. The catalyst may be used fresh, after regeneration as a sulfur sorbent or after being spent as a sulfur sorbent. In other words the catalyst that is preferred in the current sweetening process is the fresh, regenerated or spent sulfur sorbent of U.S. Pat. Nos. 4,163,708 and 4,259,213. The chemical form of the copper in such a catalyst will vary depending upon whether the catalyst is fresh or spent. A fresh or newly regenerated catalyst will primarily contain copper metal and cupric oxide. After the catalyst has been used, the copper will be in the form of cupric oxide and more commonly cuprous sulfide. With this material the copper component will constitute about 5% to about 50%, preferably 10% to 40% by weight of the catalyst calculated as copper metal. The copper component is supported and dispersed in finely divided form on a natural or synthetic refractory oxide of a Group II, III or IV metal or mixtures thereof as set forth above.

The catalyst is usually in a particulate, (e.g. pellet or extrudate) form and will usually have a specific surface area (measured by the B.E.T. method) in the range of about 30 to 300 $m^2/g$, preferably 50 to 200 $m^2/g$. The average size of the catalyst pellets will usually be in the range of about 0.08 to about 0.3 cm in diameter and about 0.3 to about one cm in length.

The catalyst is made by either (a) impregnating the carrier with an aqueous solution of a water-soluble copper salt, the anionic portion of which may be readily removed or converted to the oxide form upon drying and calcining or (b) comulling an appropriate copper compound with peptized carrier, extruding or otherwise shaping the comulled mixture into a particulate form, and calcining the extruded particles. These techniques as applied to making the preferred catalyst are described in detail in U.S. Pat. Nos. 4,163,708 and 4,259,213, which disclosures are incorporated herein by reference.

Process Conditions

In addition to employing the alcohol addition and the copper catalyst as set out above, the present invention employs "sweetening" conditions, that is a moderately elevated temperature and a solid-liquid contacting zone. Unlike prior processes, this process does not require added molecular oxygen, obtaining its oxygen from the added alcohol. Thus, this process is carried out in the substantial or complete absence of added molecular oxygen ($O_2$).The contacting could be effected in a batch mode but almost always is preferably carried out in a continuous manner. When carried out continuously, a fixed bed reactor set up is commonly employed. Such a set up may be up flow or down flow as desired. The velocity of the feedstock over the catalyst expressed as a liquid hourly space velocity (LHSV) is typically from about 1 to 20 bed volumes per hour, or as a residence time is from about 3 to about 60 minutes. Preferred LHSV's are 1.5 to 6 $hrs^{-1}$ and corresponding residence times are 40 to 10 minutes.

An elevated reaction temperature is used. Little reaction is observed below about 300° F. (150° C.) and coke formation becomes a problem above about 500° F. (260° C.). Preferred reaction temperatures are in the range of 350° F. (175° C.) and about 450° F. (240° C.). We have had best results at temperatures of from about 375° F. (190° C.) to about 425° F. (220° C.). The pressure should be such as to maintain the hydrocarbon feed in a liquid state at a given reaction temperature. Normally pressures in the range of atmospheric to 500 psig, preferably 15 psig to 300 psig will be used.

The sweetening process of the invention will typically produce a sweetened hydrocarbon that contains less than about 5 wppm mercaptan and $H_2S$ sulfur. It is noted that the process does not appear to remove any significant amount of sulfur from the hydrocarbon but merely converts mercaptans and $H_2S$ to disulfides.

The performance of the catalyst may be monitored by determining the amount of mercaptans and $H_2S$ in the process effluent using conventional analytical methods. These include the DOC test, ASTM D484, or more complex analytical procedures which provide a complete breakdown of sulfur types.

The following Examples are provided to further illustrate the process of this invention. They are not intended to limit the invention in any manner.

EXAMPLE 1

A sour naphtha (boiling range 195°–365° F.) having a mercaptan sulfur content of 20–30 wppm and an $H_2S$ content of 10–21 ppm was sweetened using a catalyst made by the comulling process of U.S. Pat. No. 4,259,213. The catalyst composition and properties were as follows:

| | |
|---|---|
| Copper | 26% as Cu metal (analyzed) |
| Alumina | 67.5% by weight |
| Pore Volume | 0.50 cc/gm |
| Average Pore Size | 130 Å |
| $N_2$ Surface Area | 170 $m^2$/gm |
| Average Particle Size | 1/16" × ¼" length pellets |

The catalyst had been employed as a sulfur sorbent catalyst and contained 6.8% sulfur. For test purposes 20 cc (16.8 gms) of the catalyst as whole 1/16" extrudate pellets was installed into a fixed bed downflow reactor. The naphtha was run through the catalyst-filled reactor for a total of 565 hrs. The LHSV was varied between 2.5 and 5.0, pressure was 200 psig, and temperatures ranged from 150° C. to 211° C. The sweetened product was analyzed periodically for sulfur and mercaptan content. Table I summarizes the process conditions and sour feed and sweetened product analyses. The catalyst contained 6.8% sulfur before the test and 6.9, 7.9 and 6.9% (three analyses) after.

TABLE I

USE OF $CH_3OH$ AS OXYGEN SOURCE IN NAPHTHA SWEETENING

| Run Hrs. | Temp (°C.) | LHSV | $CH_3OH$ in Feed (LV %) | Pressure Psig | RSH in Feed, ppm | $H_2S$ in Feed, ppm | RHS in Product, ppm | $H_2S$ in Product, ppm | Product Quality |
|---|---|---|---|---|---|---|---|---|---|
| 0–70 | 150–178 | 5 | 0 | 200 | 26 | 21 | 23 | nd | Sour |
| 70–230 | 178 | 5 | 0.13 | 200 | 28 | 17 | 12 | nd | Sweet-Sour |
| 230–490 | 211 | 5 | 0.13 | 200 | 20–30 | 11–20 | <1 to 4 | nd | Sweet |
| 490–520 | 150 | 2.5 | 0.13 | 200 | 20–30 | 10–20 | 0 | nd | Sweet |
| 520–540 | 178 | 2.5 | 0.13 | 200 | 20–30 | 10–20 | 11 | nd | Sweet-Sour |
| 540–565 | 205 | 2.5 | 0.33 | 200 | 24 | 10 | 4 | nd | Sweet |

EXAMPLE 2

The experiment of Example 1 is repeated employing equimolar amounts of ethanol, n-propanol and isopropanol in place of methanol. Similar sweetening would be observed.

EXAMPLE 3

The experiment of Example 1 was repeated with changes. El Paso LSR naphtha (83.1° API gravity, 100°–230° F. boiling range) containing 180 ppm of mercaptan sulfur and 200 ppm total sulfur was used as hydrocarbon feed. Methanol was added to the feed at various levels. The catalyst was a used copper on aluminum sulfur-sorber catalyst. The feed was passed over the catalyst at various temperatures and LHSVs. The run is summarized in Table II. This run showed that at temperatures of 190° C. and especially 200° C. this process was very effective at sweetening.

TABLE II

USE OF $CH_3OH$ AS OXYGEN SOURCE IN NAPHTHA SWEETENING

| Run Hrs. | Temp (°C.) | LHSV | $CH_3OH$ in Feed (LV %) | Pressure Psig | RSH in Feed, ppm | Total Sulfur Feed, ppm | RHS in Product, ppm | Product Quality |
|---|---|---|---|---|---|---|---|---|
| 3300–3400 | 175 | 2 | 0.075 | 60 | 180 | 200 | 70 | Sour |
| 3400–3500 | 175 | 3 | 0.12 | 60 | 180 | 200 | 80–120 | Sour |
| 3500–3525 | 175 | 2 | 0.075 | 60 | 180 | 200 | 20–50 | Sour |
| 3575–3650 | 190 | 2 | 0.18 | 60 | 180 | 200 | 10–20 | Sour |
| 3650–3825 | 205 | 2 | 0.18 | 60 | 180 | 200 | <2 | Sweet |
| 3825–3900 | 205 | 2 | 0.18 | 125 | 180 | 200 | <2 | Sweet |
| 3900–3990 | 205 | 2 | 0.25 | 200 | 180 | 200 | <1 | Sweet |
| 3990–4150 | 205 | 2 | 0.10 | 200 | 180 | 200 | <2 | Sweet |
| 4150–4300 | 205 | 2 | 0.18 | 200 | 180 | 200 | <2 | Sweet |

Modifications of the above-described embodiments of the invention that are obvious to those of skill in the hydrocarbon refining and related arts are intended to be within the scope of the following claims.

We claim:

1. A process for sweetening a sour hydrocarbon comprising admixing with said hydrocarbon a small amount of lower alcohol, said alcohol serving as a source of oxygen, and contacting the mixture in liquid phase under sweetening conditions with a catalyst comprising copper whereby mercaptans in the sour hydrocarbon are converted to disulfides and thereby the hydrocarbon is sweetened.

2. The process of claim 1 wherein the small amount is from about 50 to about 1000 ml per barrel of hydrocarbon.

3. The process of claim 2 wherein the lower alcohol is methanol.

4. The process of claim 2 wherein the alcohol is ethanol.

5. The process of claim 1 wheren the copper-containing catalyst is a supported copper catalyst.

6. The process of claim 1 wherein the copper-containing catalyst is a supported copper sulfide catalyst.

7. The process for sweetening a sour hydrocarbon having a boiling range of from about 10° C. to about 350° C. at 760 mm Hg and containing from about 10 to about 500 ppm by weight of mercaptan and/or $H_2S$ sulfur which comprises admixing with said sour hydrocarbon from about 50 to about 1000 ml per barrel of a lower alcohol and contacting the mixture in liquid phase in the absence of added molecular oxygen with a copper-containing catalyst at a temperature of from about 150° C. to about 260° C. for from 3 to 60 minutes thereby converting sour mercaptans to disulfides.

8. The process of claim 7 wheren the copper-containing catalyst is a supported copper catalyst.

9. The process of claim 7 wherein the copper-containing catalyst is a supported copper sulfide catalyst.

10. The process of claim 7 wherein the alcohol is methanol.

11. The process of claim 10 wherein the temperature is from 175° C. to 240° C.

12. The process of claim 10 wherein the temperature is from 190° C. to 220° C.

13. The process of claim 11 wherein the copper-containing catalyst is a supported copper catalyst.

14. The process of claim 12 wherein the copper-containing catalyst is a supported copper sulfide catalyst.

* * * * *